US010392215B2

(12) United States Patent
Mark et al.

(10) Patent No.: US 10,392,215 B2
(45) Date of Patent: Aug. 27, 2019

(54) SPLICING DEVICE

(71) Applicant: BHS Corrugated Maschinen-und Anlagenbau GmbH, Weiherhammer (DE)

(72) Inventors: Maximilian Mark, Tirschenreuth (DE); Alfons Gnan, Vilseck (DE); Norbert Städele, Parkstein (DE)

(73) Assignee: BHS CORRUGATED MASCHINEN-UND ANLAGENBAU GMBH, Weiherhammer (DE)

( * ) Notice: Subject to any disclaimer, the term of this patent is extended or adjusted under 35 U.S.C. 154(b) by 204 days.

(21) Appl. No.: 15/272,942

(22) Filed: Sep. 22, 2016

(65) Prior Publication Data

US 2017/0088380 A1 Mar. 30, 2017

(30) Foreign Application Priority Data

Sep. 24, 2015 (DE) ..... 10 2015 218 321

(51) Int. Cl.
*B65H 16/02* (2006.01)
*B65H 19/14* (2006.01)
(Continued)

(52) U.S. Cl.
CPC ..... *B65H 19/18* (2013.01); *B65H 16/021* (2013.01); *B65H 19/14* (2013.01);
(Continued)

(58) Field of Classification Search
CPC .. B65H 19/18; B65H 16/021; B65H 19/1852; B65H 19/20; B65H 19/14; B65H 2301/412845; B65H 2408/2211; B65H 2301/463; B65H 2301/46024; B65H 2301/4139; B65H 2301/41704; B65H 2511/20
See application file for complete search history.

(56) References Cited

U.S. PATENT DOCUMENTS 3,841,944 A * 10/1974 Harris, Jr. ..... B65H 19/1852 156/159
3,880,698 A * 4/1975 Kawazura ..... B65H 19/1831 156/504
(Continued)

FOREIGN PATENT DOCUMENTS

DE 10 2010 008 906 A1 11/2010
DE 10 2011 115 936 A1 4/2012
EP 1 127 820 A1 8/2001

*Primary Examiner* — William A. Rivera
(74) *Attorney, Agent, or Firm* — McGlew and Tuttle, P.C.

(57) ABSTRACT

The invention concerns a splicing facility for splicing material webs. The splicing facility comprises a first dispensing device for dispensing a finite first material web from a first material web roll, a second dispensing device for dispensing a finite second material web from a second material web roll, a third dispensing device for dispensing a third material web, a first splicing device for splicing together the finite first material web and the finite second material web to an endless material web and a second splicing device for splicing together the third material web and the finite first material web or the finite second material web to the endless material web. The first splicing device and the second splicing device are arranged at different heights.

20 Claims, 9 Drawing Sheets

(51) Int. Cl.
*B65H 19/18* (2006.01)
*B65H 19/20* (2006.01)

(52) U.S. Cl.
CPC ..... *B65H 19/1852* (2013.01); *B65H 19/20* (2013.01); *B65H 2301/4139* (2013.01); *B65H 2301/41704* (2013.01); *B65H 2301/412845* (2013.01); *B65H 2301/463* (2013.01); *B65H 2301/46024* (2013.01); *B65H 2408/2211* (2013.01); *B65H 2511/20* (2013.01)

(56) References Cited

U.S. PATENT DOCUMENTS 4,100,012 A * 7/1978 Meihofer ..... B65H 23/1888 156/351
4,190,475 A * 2/1980 Marschke ..... B65H 19/1852 156/157
4,450,039 A * 5/1984 Salvucci ..... B65H 19/1852 156/159
4,949,910 A * 8/1990 Kleitz ..... B65H 19/123 156/502
5,171,396 A * 12/1992 Rank ..... B65H 19/1852 156/157
5,394,778 A * 3/1995 Sakowski ..... B65H 19/10 83/106
5,975,457 A * 11/1999 Forbes ..... B65H 19/102 242/552
6,817,566 B2 * 11/2004 Clifford ..... B65H 19/14 156/564
7,543,775 B2 * 6/2009 Benvenuti ..... B65H 16/06 242/533
7,938,925 B2 * 5/2011 Cummings ..... B65H 19/1852 156/157
8,550,395 B2 * 10/2013 Nash ..... B65H 19/1836 242/555.4
8,628,038 B2 * 1/2014 Muller ..... B65H 19/1852 242/552
2001/0018953 A1 9/2001 Gnan et al.
2004/0084133 A1 5/2004 Adami
2012/0085483 A1 4/2012 Cummings

* cited by examiner

SPLICING DEVICE

CROSS-REFERENCE TO RELATED APPLICATIONS

This application claims the priority of German Patent Application Serial No. 10 2015 218 321.1 filed on Sep. 24, 2015, pursuant to 35 U.S.C. 119 (a)-(d), the content of which is incorporated herein in its entirety as if fully set forth herein.

FIELD OF THE INVENTION

The invention concerns a splicing facility for splicing material webs, in particular paper webs for producing at least one corrugated cardboard web in a corrugated cardboard plant. Furthermore, the invention concerns a method for splicing corresponding material webs.

BACKGROUND OF THE INVENTION

Known splicing facilites join a finite first material web coming to its end to a new finite second material web so that a material web is produced that is endless so to speak. This process is known in the trade as splicing and corresponding facilities are termed splicing facilities. To produce corrugated cardboard webs, the endless material webs are generally joined together one on top of the other.

Tandem splicing facilities are also known from the state of the art. DE 10 2011 115 936 A1 discloses a splicing facility of this type. A splicing facility of this type carries more than two material web rolls, whose finite material webs are used to produce the endless material web. A disadvantage of these types of splicing facility is that they require a particularly large amount of space in the direction in which the machine runs. Also in these cases, since the so-called supply unit of the material web has to be fed from underneath, it is necessary to incorporate an accessible and displaceable platform between the two splicing devices which form the tandem splicing facility so that the material web running out of the first or upstream splicing device can be threaded into the second or downstream splicing device. This has proved to be impractical and is costly.

SUMMARY OF THE INVENTION

The invention is based on the task of overcoming the disadvantages of the state of the art. In particular, the aim is to create a splicing facility with at least three dispensing devices and to join at least three material webs, requiring a very small amount of space. Also, a particularly simple retrofit of the splicing facility is to be made possible. Furthermore, a corresponding method is to be provided.

This task is resolved according to the invention by a splicing facility for splicing material webs, comprising a first dispensing device for dispensing a finite first material web from a first material web roll, a second dispensing device for dispensing a finite second material web from a second material web roll, a third dispensing device for dispensing a third material web, a first splicing device for splicing together the finite first material web and the finite second material web to an endless material web, and a second splicing device for splicing together the third material web and the finite first material web or the finite second material web to the endless material web, wherein the first splicing device and the second splicing device are arranged at different heights, and by a method for splicing material webs, comprising the following steps: dispensing a finite first material web from a first material web roll by means of a first dispensing device, dispensing a finite second material web from a second material web roll by means of a second dispensing device, dispensing a third material web by means of a third dispensing device, splicing the finite first material web and finite second material web to an endless material web by means of a first splicing device, and splicing the third material web and the finite first material web or the finite second material web to the endless material web by a second splicing device, wherein the first splicing device and the second splicing device are arranged at different heights. The main concept of the invention is based on arranging the splicing devices of the splicing facility at different heights, in particular underground, on the ground or similar The splicing facility is advantageously able to store and unwind at least two finite material webs. Moreover, the splicing facility is, in particular, able to process at least three material webs. The inventive splicing facility forms a kind of tandem splicing facility. The finite first and second material webs can be spliced to the endless material web by means of the first splicing device. The second splicing device is used to splice the third material web to the endless material web. The inventive splicing facility advantageously occupies an extremely small amount of floor area only and is particularly short in the conveying direction of the material web(s).

It is advantageous if, in the case, for example, of a fault in a printing device in the corrugated cardboard plant, it is possible to switch over to an unprinted order or order with preprinted rollers using the splicing facility.

Advantageously, the splicing devices are substantially the same in their essental construction. In particular, they work substantially in the same way also.

It is expedient if the splicing facility is a component part of a corrugated cardboard plant. Advantageously the corrugated cardboard plant comprises at least one such splicing facility.

It is advantageous if the finite material webs are finite paper webs. It is expedient if the endless material web forms a laminating web of a later corrugated cardboard web or corrugated cardboard. Advantageously the endless material web is joined to a corrugated cardboard web laminated on one side.

Advantageously the third material web differs from the finite first material web and/or the finite second material web. For example the third material web is printed, whereas the finite first and second material webs are unprinted. Alternatively, for example, the third material web is unprinted while the finite first and second material webs are printed.

The third material web is either finite or endless. To produce a finite third material web, the third dispensing device is advantageously designed as an unwinding device, arranged with a gap from or adjacent to the inventive splicing facility. To produce an endless third material web, the third dispensing device is advantageously designed as an appropriate conventional splicing device, arranged with a gap from or adjacent to the inventive splicing facility. For example, between the conventional splicing facility or unwinding device and the inventive splicing facility, at least one processing unit is arranged to process the third material web or a printing unit to print the third material web.

The tiered layout of the splicing facility such that the first splicing device and the second splicing device are arranged one over the other results in a splicing facility which occupies an extremely small floor area. Known splicing facilities with just two unwinding devices can be converted particularly simply, for example, using the inventive splicing facility since their floor areas are substantially the same in the main. Principally, their lengths are substantially identical generally in the conveying direction of the material web(s), so that no space problems occur in incorporating the inventive splicing facility into an existing corrugated cardboard plant.

The statements made in reference to the embodiment in which the second splicing device is arranged above the first splicing device apply substantially equally to the embodiment in which the first splicing device and the second splicing device overlap each other at least in certain regions.

The splicing facility in which the second splicing device projects laterally compared with the first splicing device towards the third unwinding device in particular enables the third material web to be inserted particlarly simply into the second splicing device or splicing facility.

The splicing facility in which the first splicing device and the second splicing device are supported on a common base frame can be fitted particularly simply and quickly.

In one embodiment, the first splicing device comprises at least one joining unit for splicing the finite material web requiring splicing to the endless material web, at least one displaceable supply unit for feeding the finite material web requiring splicing to the at least one joining unit and a displaceable first table unit to interact with the at least one joining unit and/or with the at least one supply unit.

It is advantageous if the at least one joining unit is able to splice the finite first and/or second material web(s) to the endless material web or to join the finite first and second finite material webs together. It is advantageous if the at least one joining unit, for example, where a finite second material web is nearing its end, joins, in particular glues the finite first material web to the endless material web or, respectively, where a finite first material web is nearing its end, joins, in particular glues the finite second material web to the endless material web.

It is expedient if the at least one joining unit also comprises at least one cutting means.

Advantageously exactly two joining units are present. A joining unit is prefeably provided for splicing the finite first material web to the endless material web, while the other joining unit is provided for splicing the finite second material web to the endless material web.

It is advantageous if the at least one supply unit can be displaced linearly.

Advantageously the first splicing device has exactly two supply units. It is advantageous if the finite first material web is associated with one supply unit and the finite second material web is associated with the other supply unit.

It is advantageous if the first table unit can be displaced linearly.

In one embodiment, the second splicing device comprises at least one splicing unit for splicing the third material web requiring splicing with the endless material web, at least one displaceable further supply unit for feeding the material web requiring splicing to the at least one further joining unit and a displaceable second table unit to interact with the at least one further joining unit and/or with the at least one further supply unit.

It is advantageous if the at least one splicing unit of the second splicing device is able to splice the third material web to the endless material web. It is advantageous if the joining unit of the second splicing device, for example, where a finite second material web is nearing its end, joins, in particular glues the third material web to the endless material web or, where a finite first material web is nearing its end, joins, in particular glues the third material web to the endless material web. Advantageously the joining unit of the second splicing device is also able, for example, to join, in particular glue the third material web to the finite second material web or to the finite first material web at a distance from the ends of the first or second material web. Advantageously it is also possible to splice the third material web to the endless material web when the finite first or second material web is not yet at its end.

It is expedient if the at least one joining unit of the second splicing device also comprises at least one cutting means.

Advantageously exactly two second joining units are present. A joining unit is provided preferably to splice the third material web to the endless material web, while the other joining unit is provided to splice the finite first and/or second material web(s) to the endless material web.

It is advantageous if the at least one supply unit of the second splicing device can be displaced linearly.

Advantageously the second splicing device has exactly two supply units. It is advantageous if one supply unit is assigned to the third material web and the other supply unit is assigned to the finite first or second material web.

It is advantageous if the second table unit can be displaced linearly.

The splicing device comprising a storage device for creating or dispersing material web loops in the created endless material web allows splicing without changing the conveying speed of the endless material web.

The splicing device in which the storage device is arranged above the first splicing device and second splicing device requires a particularly small floor area only, simplifying the incorporation of the inventive splicing facility in an existing corrugated cardboard plant.

A preferred embodiment of the invention is described by way of example below with references to the attached drawings.

DESCRIPTION OF THE PREFERRED EMBODIMENT

Figure 1:
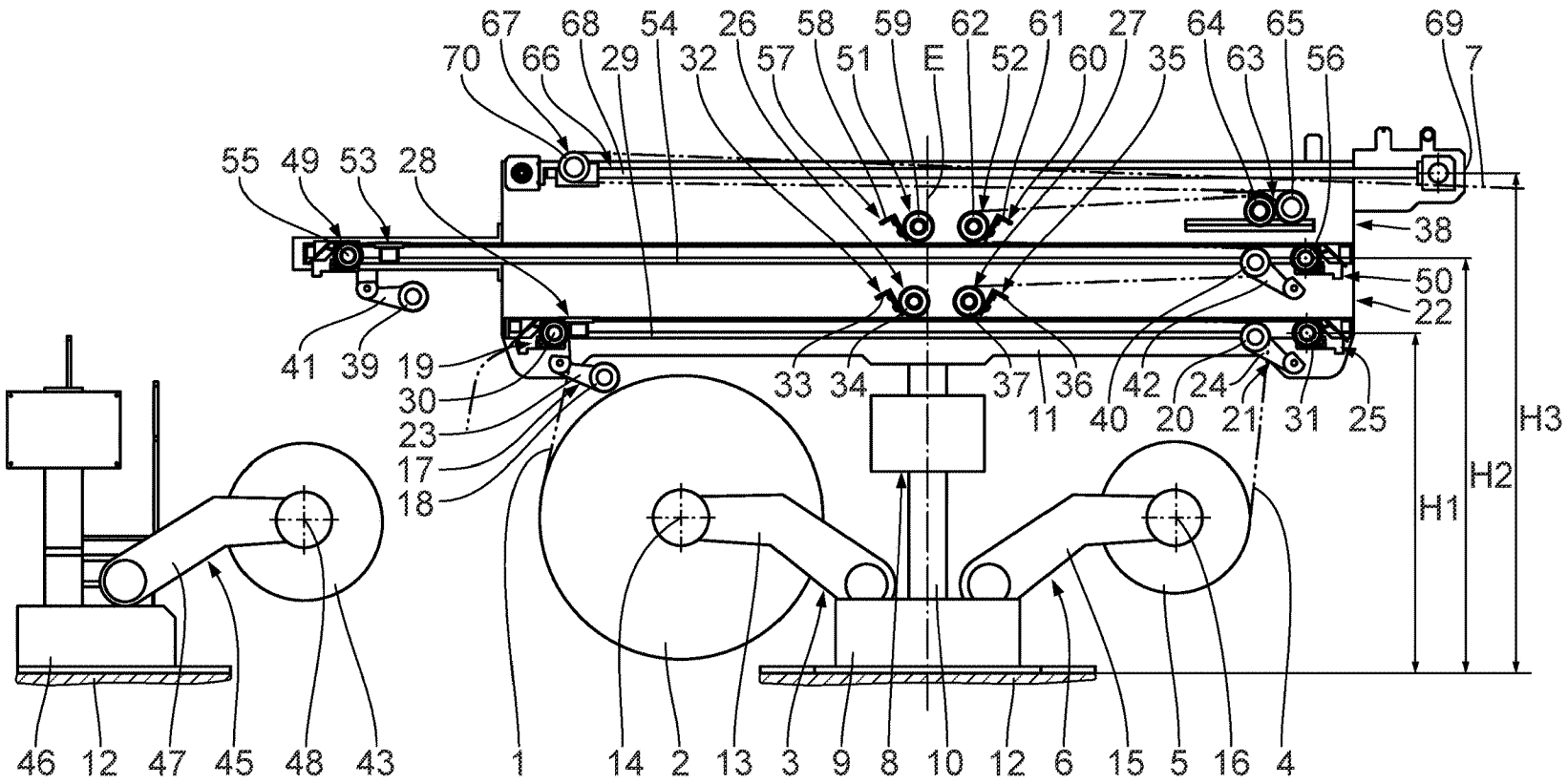
FIG. 1 a diagrammatic side view of an inventive splicing facility, in which splicing the finite first material web to the endless material web is provided and the finite second material web is being unwound, FIG. 2 a view corresponding to FIG. 1 showing the progress of the intended splicing of the finite first material web to the endless material web, FIG. 3 a view corresponding to FIG. 1 showing the conclusion of the splicing of the finite first material web to the endless material web, FIG. 4 a view corresponding to FIG. 1 showing the provision of splicing of the third material web to the endless material web and the unwinding of the finite first material web, FIG. 5 a view corresponding to FIG. 1 showing the progress of the intended splicing of the third material web to the endless material web, FIG. 6 a view corresponding to FIG. 1 showing the conclusion of the splicing of the third material web to the endless material web, FIG. 7 a view corresponding to FIG. 1 showing the provision of splicing of the finite second material web to the endless material web and the unwinding of the third material web, FIG. 8 a view corresponding to FIG. 1 showing the progress of the intended splicing of the finite second material web to the endless material web, and FIG. 9 a view corresponding to FIG. 1 showing the conclusion of the splicing of the finite second material web to the endless material web.

A splicing facility illustrated in the Figures as a component part of a corrugated cardboard plant (not shown) comprises a first dispensing device 3 to unwind a finite first material web 1 from a first material web roll 2 and a second dispensing device 6 to unwind a finite second material web 4 from a second material web roll 5. The finite first material web 1 and the finite second material web 4 can be joined together in the splicing facility to produce an endless material web 7. The dispensing devices 3, 6 are designed as unwinding devices.

The splicing facility has a base frame 8 with a base frame plinth 9, a base frame column 10 and a base frame support 11. The base frame plinth 9 is fixed to the ground 12, which is a factory shop floor, for example. The base frame column 10 extends substantially vertically, or perpendicular to the ground 12. The base frame support 11 is attached to the base frame column 10 at one end opposite the base frame plinth 9 and runs substantially parallel to the ground 12. The base frame support 11 extends substantially over the first material web roll 2 and the second material web roll 5.

The first unwinding device 3 and the second unwinding device 6 extend out from the base frame plinth 9. The unwinding devices 3, 6 are pivoted to swivel on the base frame plinth 9 and are arranged opposite each other in relation to the base frame column 10.

In order to accommodate the first material web roll 2, the first unwinding device 3 has a seating taper (not shown) which is guided into a central opening of the first material web roll 2 and is mounted between two first carrier arms 13 of the first unwinding device 3 running parallel to each other, to rotate about a first rotational axis 14.

The design of the second unwinding device 6 corresponds to that of the first unwinding device 3. In order to accommodate the second material web roll 5, it has a seating taper (not shown) which is guided into a central opening of the second material web roll 5 and is mounted between two second carrier arms 15 of the second unwinding device 6 running parallel to each other to rotate about a second rotational axis 16. The rotational axes 14, 16 run parallel to each other.

The finite first material web 1 from the first material web roll 2 can be fed by a first feeding device 17 with a first feeding roll 18 and the finite second material web 4 is can be fed by a second feeding roll 20 of a second feeding device 21 of a first splicing device 22 or of the splicing facility. The first splicing device 22 is arranged on the base frame support 11. The feeding rolls 18, 20 can rotate on support arms 23 or 24 the first or second feeding device 17 or 21 respectively, which are arranged on the base frame support 11 above the material web rolls 2 or 5 respectively to rotate and to tension the finite first material web 1 or the finite second material web 4 respectively.

The first splicing device 22 serves to produce the endless material web 7 from the finite material webs 1, 4 and has a first supply unit 19, a second supply unit 25, a first joining unit 26, a second joining unit 27, a first table unit 28 and a first guide 29. The first splicing device 22 is arranged at a height H1 above the ground 12.

The first guide 29 runs substantially parallel to the ground 12 between the supply units 19, 25. The supply units 19, 25 are displaceable along the first guide 29. The first table unit 28 is displaceable along the first guide 29 between the supply units 19, 25.

The joining units 26, 27 are arranged with gaps between each other along the first guide 29. They are arranged on the base frame support 11 above the first guide 29 between the feeding devices 17, 21 or in the region above and between the material web rolls 2, 5.

The supply units 19, 25 are built identically and, relative to a vertically running symmetry plane E, are arranged symmetrically to be displaced along the first guide 29.

In order to feed the finite first material web 1, the first supply unit 19 has a first glueing roller 30 mounted to rotate in the first guide 29 and a first cross cut unit (not shown) with an actuated first cutting knife to cut the supplied finite first material web 1. In order to feed the finite first material web 1, the first glueing roller 30 is provided with an adhesive layer and is displaceable to transport the first finite material web 1 from the associated first cross cut unit to the second joining unit 27 along the first guide 29.

In order to feed the finite second material web 5, the second supply unit 25 has a second glueing roller 31 mounted to rotate in the first guide 29 and, in order to cut the supplied finite second material web 5, has a second cross cut unit (not shown) with an actuated second cutting knife. In order to feed the finite second material web 4, the second glueing roller 31 is provided with an adhesive layer and is displaceable to transport the finite second material web 4 from the associated second cross cut unit to the first joining unit 26 along the first guide 29.

The joining units 26, 27 are built identically and, relative to the symmetry plane E, are arranged symmetrically on the base frame support 11.

In order to cut the finite second material web 4 before joining to the finite first material web 1, the first joining unit 26 comprises a first cross cut unit 32 with an actuated first cutting knife 33 and a first nip roller 34 to join the finite material webs 1, 4 to the endless material web 7. The first cross cut unit 32 of the first joining unit 26 and its first nip roller 34 are attached, directly adjacent to the first guide 29, to the base frame support 11 such that the glueing rollers 30, 31 of the supply units 19, 25 and the first table unit 28 can be directed along the first guide 29 past the first joining unit 26.

In order to cut the finite first material web 1 before joining to the finite second material web 4, the second joining unit 27 comprises a second cross cut unit 35 with an actuated second cutting knife 36 and a second nip roller 37 to join the finite material webs 1, 4 to the endless material web 7. The second cross cut unit 35 of the second joining unit 27 and its second nip roller 37 are attached, directly adjacent to the first guide 29, to the base frame support 11 such that the glueing rollers 30, 31 of the supply units 19, 25 and the first table unit 28 can be directed along the first guide 29 past the second splicing unit 27.

The first table unit 28 interacts with the supply units 19, 25 and/or with the joining units 26, 27 and is displaceable independently of the latter along the first guide 29.

A second splicing device 38 of the splicing facility is arranged downstream of the first splicing device 22 relative to the conveying direction of the endless material web 7. The second splicing device 38 is arranged above the first splicing device 22 on the base frame support 11 at a height H2 above the ground 12 which is higher than H1. The splicing devices 22, 38 built substantially identically. The splicing devices 22, 38 arranged one over the other can also be attached alternatively to the underside of a bridge of the corrugated cardboard plant.

A third feeding roll 39 of a third feeding device and a fourth feeding roll 40 of a fourth feeding device are arranged on the base frame support 11 between the splicing devices 22, 38. The third feeding roll 39 is arranged advantageously above at least one third material web roll 43. It is arranged above the first material web roll 2 and laterally to it. The third feeding roll 39 is arranged above the first and at least one third material web roll 2, 43 and is arranged between them. The fourth feeding roll 40 is arranged above the second material web roll 5 or, respectively, the second feeding roll 20.

In order to deliver a third material web 44 from the at least one third material web roll 43, the splicing facility comprises a third unwinding device 45. The third dispensing device 45 is arranged laterally next to the first unwinding device 3 and the second unwinding device 6. The first unwinding device 3 is located between the third dispensing device 45 and the second unwinding device 6.

The third dispensing device 45 extends out from a base frame plinth 46. It is mounted to swivel on the base frame plinth 46. The base frame plinth 46 is fastened to the ground 12. Instead of two separate base frame plinths 9, 46, it is possible, for example, to have a common base frame plinth.

In order to accommodate the at least one third material web roll 43, the third dispensing device 45 has at least one seating taper (not shown) which is guided into a central opening of the respective third material web roll 43 and is mounted between at least two third carrier aims 47 of the third dispensing device 45 running parallel to each other, to rotate about at least one third rotational axis 48. The at least one third rotational axis 48 runs parallel to the first rotational axis 14 and the second rotational axis 16.

The second splicing device 38 is located advantageously above the first splicing device 22, so that it runs above the at least one third material web roll 43 or the third dispensing device 45.

The third material web 44 from the at least one third material web roll 43 can be fed by the third feeding device, and the endless material web 7, consisting of the finite first or, respectively second material web 1, 4, can be fed by the fourth feeding device of the second splicing device 38.

In order to tension the third material web 44 or, respectively, the endless material web 7, consisting of the finite first or second material web 1, 4, the feeding rolls 39, 40 are arranged to rotate on carrier arms 41 or 42 of the third or fourth feeding device, which are arranged to swivel on the base frame support 11 above the first splicing device 22.

The second splicing device 38 serves to produce the endless material web 7 from the finite first material web 1 or the third material web 44 or out of the finite second material web 4 or the third material web 44. The second splicing device 38 has a third supply unit 49, a fourth supply unit 50, a third joining unit 51, a fourth joining unit 52, a second table unit 53 and a second guide 54.

Since the second splicing device 38 is located above the first splicing device and extends over the third material web roll 43, the third supply unit 49 and the first supply unit 19 are accessible simultaneously for manually supplying and fitting new material web rolls 2 or 43.

The second guide 54 runs between the supply units 49, 50 substantially parallel to the ground 12, wherein the supply units 49, 50 are displaceable along the second guide 54. The second table unit 53 is displaceable between the supply units 49, 50 along the second guide 54.

The joining units 51, 52 are arranged along the second guide 54 with gaps between them. They are arranged on the base frame support 11 above the second guide 54 between the third and fourth feeding devices or in the region above between the material web rolls 2, 5. The joining units 51, 52 are arranged above the joining units 26, 27 and are adjacent to them.

The supply units 49, 50 are built identically to one another and are arranged to be displaceable along the second guide 54 relative to the symmetry plane E. Beside the third supply unit 49, in an alternative embodiment the fourth supply unit 50 can also be spaced further away from the symmetry plane E compared with the second supply unit 25 for ease of access. The supply units 49, 50 are designed exactly like the supply units 19, 25.

In order to feed the third material web 44, the third supply unit 49 has a third glueing roller 55 rotatably mounted in the second guide 54 and, in order to cut the fed third material web 44, has a third cross cut unit (not shown) with an actuated third cutting knife. In order to feed the third material web 44, the third glueing roller 55 is provided with an adhesive layer and, in order to transport the third material web 44 from the associated third cross cut unit to the fourth joining unit 51, is displaceable along the second guide 54.

In order to feed the endless material web 7 consisting of the finite first material web 1 or the finite second material web 4, the fourth supply unit 50 has a fourth glueing roller 56 rotatably mounted in the second guide 54 and, in order to cut the fed endless material web 7, has a fourth cross cut unit (not shown) with an actuated fourth cutting knife. In order to feed the endless material web 7, consisting of the finite first material web 1 or the finite second material web 4, the fourth glueing roller 56 is provided with an adhesive layer and, in order to transport this endless material web 7 from the associated fourth cross cut device to the third joining unit 52, is displaceable along the second guide 54.

The third joining unit 51 and the fourth joining unit 52 are built identically and arranged symmetrically to the base frame support 11 relative to the symmetry plane E. The joining units 51, 52 also are built exactly the same as the joining units 26, 27.

In order to cut the endless material web 7, consisting of the finite first material web 1 or the finite second material web 4, before joining to the finite third material web 44, the third joining unit 51 comprises a third cross cut unit 57 with an actuated third cutting knife 58 and, in order to join the finite third material web 44 and the endless material web 7, consisting of the finite first material web 1 or the finite second material web 4, to the endless material web 7, comprises a third nip roller 59. The third cross cut unit 57 of the third joining unit 51 and its third nip roller 59 are fastened directly to the base frame support 11 adjacent to the second guide 54 such that the glueing rollers 55, 56 and the second table unit 53 are able to be directed along the second guide 54 past the third joining unit 51.

In order to cut the third material web 44 before joining to the endless material web 7, consisting of the finite first material web 1 or the finite second material web 4, the fourth joining unit 52 comprises a fourth cross cut unit 60 with a actuated fourth cutting knife 61 and, in order to join the finite material web 44 with the endless material web 7, consisting of the finite first material web 1 or the finite second material web 4, to the endless material web 7, comprises a fourth nip roller 62. The fourth cross cut unit 60 of the fourth joining unit 52 and its fourth nip roller 62 are fastened directly to the base frame support 11 adjacent to the second guide 54 such that the glueing rollers 55, 56 of the supply units 49, 50 and the second table unit 53 are able to be directed along the second guide 54 past the fourth joining unit 52.

The second table unit 53 interacts with the supply units 49, 50 and/or with the joining units 51, 52 and is displaceable along the second guide 54 independently of them.

Downstream of the second splicing device 38 relative to the conveying direction of the endless material web 7, the splicing facility has a material web redirection arrangement 63 with a first redirecting roller 64 and a second redirecting roller 65 arranged adjacent to it. The material web redirection arrangement 63 is arranged above the second splicing facility 38 on the base frame support 11. It is located above the fourth redirecting roll 40 and adjacent to it.

Downstream of the material web redirection arrangement 63 relative to the conveying direction of the endless material web 7, the splicing facility has a storage device 66 for the endless material web 7. The storage device 66 is arranged above the second splicing device 38 on the base frame support 11.

The storage device 66 comprises a storage carriage 67, which is arranged on the base frame support 11 and is displaceable along a storage carriage guide 68. The storage carriage guide 68 extends parallel to the ground 12 and to the guides 29, 54. It is arranged at a height H3 above the ground 12, which is greater than heights H1 and H2.

The storage carriage guide 68 provides a displacement path for the storage carriage 67. It extends substantially along of the entire base frame support 11. Thus the storage carriage 67 is displaceable between a first end position and a second end position. It is displaceable in opposite displacement directions. In the first end position, the storage carriage 67 is arranged adjacent to an outlet 69 where the endless material web 7 leaves the splicing facility, while the storage carriage 67 is located in the second end position with a gap or at a distance from the outlet 69 adjacent to the third feeding device. The storage carriage 67 can also occupy intermediate positions. The storage carriage 67 carries a material web redirecting roll 70 which is mounted to rotate.

Downstream from the outlet 69 relative to the conveying direction of the endless material web 7, the corrugated cardboard plant advantageously comprises, amongst other things, a preheating device (not shown), a glueing unit (not shown) and a double facer (not shown) to join the endless material web 7 to at least one multi-layer corrugated cardboard web.

The way in which the splicing facility works is described in more detail below. In doing so, the splicing of the finite first material web 1 to the finite second material web 4 is described with reference to FIGS. 1 to 3. Afterwards, the changeover from the second material web roll 5 to the first material web roll 2 is explained when the second material web roll 5, for example, is nearing its end.

The finite second material web 4 is first unwound from the second material web roll 5 and fed into the first splicing device 22 by the second feeding roll 20, wherein the finite second material web 4 is redirected by approximately 90°.

The finite second material web 4 is fed into the first splicing device 22 around the second nip roller 37. At the second nip roller 37, the finite second material web 4 is redirected by approximately 180°. It is then fed from the first splicing device 22 and to the fourth feeding roll 40, where the finite second material web 4 is redirected by approximately 180° and is fed to the second splicing device 38.

In the second splicing device 38, the finite second material web 4 is fed around the fourth nip roller 62. Here, the finite second material web 4 is redirected by approximately 180°.

The finite second material web 4 is then redirected from the first redirecting roller 64 and fed around the second redirecting roller 65. In the case of the second redirecting roller 65, the finite second material web 4 is redirected by approximately 180°.

The finite second material web 4 then runs around the material web redirecting roll 70 of the storage carriage 67 which is located in its second end position opposite the outlet 69. Thus the storage device 66 is filled with the endless material web 7. In the case of the material web redirecting roll 70 the finite second material web 4 is redirected by approximately 180°.

The finite second material web 4 is then fed to the outlet 69 where it leaves the splicing facility.

In this case, the supply units 19, 25, 49, 50 have no functional role.

Since the finite second material web 4 is unwinding continuously, the second material web roll 5 approaches its end after a certain time so that, for example, the finite second material web 4 has to be joined to the finite first material web 1 in order to provide the endless material web 7 and to ensure that the corrugated cardboard plant operates continuously.

Figure 2:
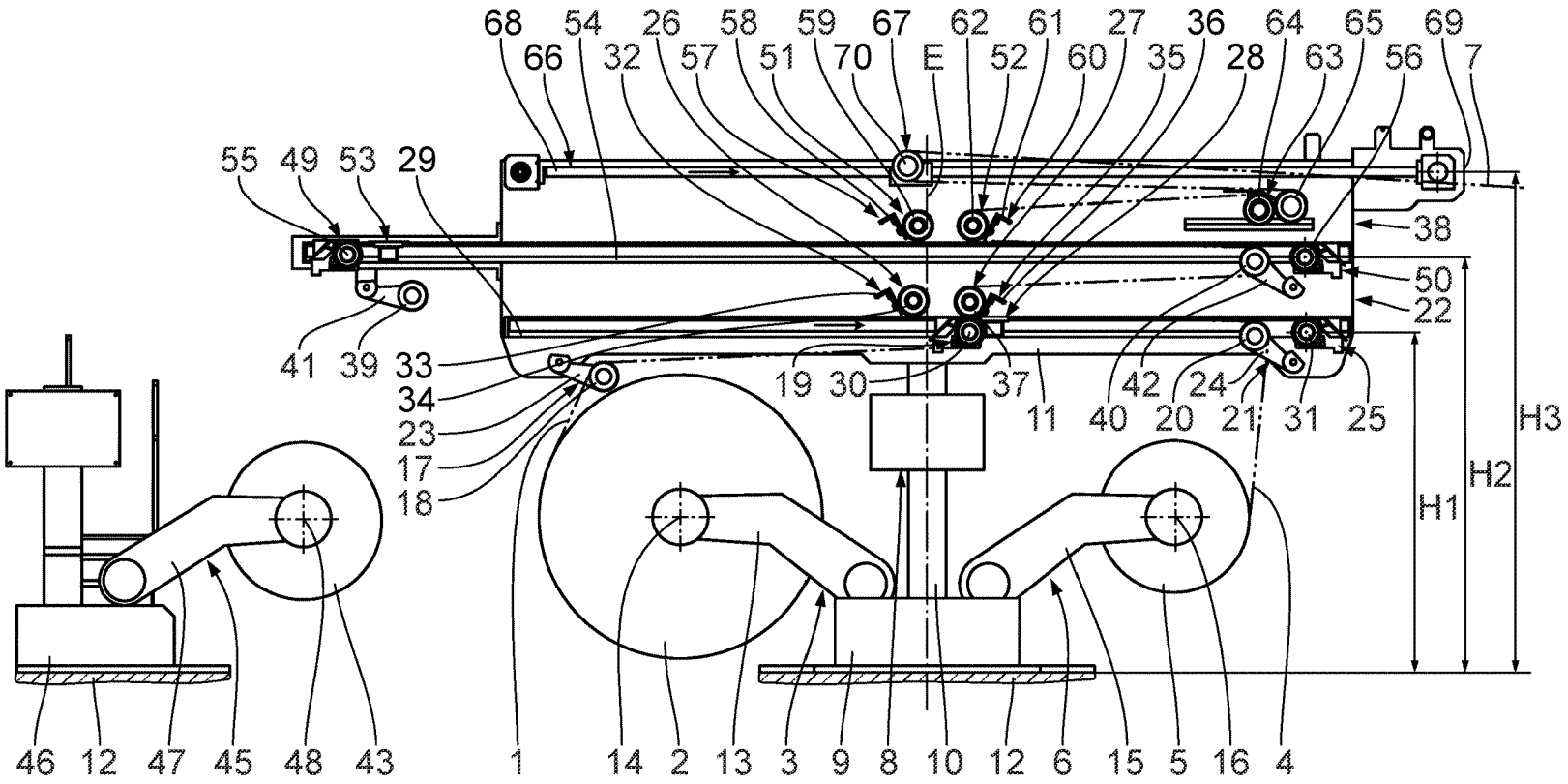

To accomplish this, the finite first material web 1 is first threaded by the first feeding device 17 through the first supply unit 19. In addition, the first supply unit 19 is arranged adjacent to the first feeding device 17. The first table unit 28 is arranged adjacent to the first supply unit 19, so that the finite first material web 1 is fixed to the first supply unit 19 or to its first glueing roller 30. Then, the finite first material web 1 is cut off by the first supply unit 19 or its first cross cut unit respectively, or manually. Then, the finite first material web 1 is provided, at its beginning where it has been cut, with a single-sided or double-sided adhesive strip, which is done preferably by the first supply unit 19. This condition is illustrated in FIG. 1.

Next, the first supply unit 19 and the first table unit 28 are displaced along the first guide 29 to the second splicing unit 27 (FIG. 2), wherein the first splicing unit 26 is passed.

During this, the storage carriage 67 is displaced towards its first end position. By displacing the storage carriage 67 towards the outlet 69, the loops formed by the endless material web 7 are dissipated in order that the endless material web 7 continues on to leave the splicing device without interruption or is conveyed without interruption.

Then, the endless material web 7, by means of the second nip roller 37 of the second splicing unit 27, wherein this second nip roller 37 is directed by a pneumatically-operated swivel unit (not shown) to the glueing roller 30 of the first supply unit 19, is pressed against the glued end of the single-sided adhesive strip, which is applied to the start of the finite first material web 1 and is located at a predetermined position on the first glueing roller 30 of the first supply unit 19. A joint is formed in this manner between the endless material web 7 and the finite first material web 1.

Then the unwinding action of the second unwinding device 6, i.e. the finite second material web 4, is stopped.

In order to produce a cut edge, the first table unit 28 is displaced along the first guide 29 such that a cut by the second blade 36, displaced by a linear unit (not shown), of the second cross cut device 35 of the second splicing unit 27 can plunge into a recess provided across the entire width in the first table unit 28 for the second cutting knife 36 of the second cross cut device 35 of the second splicing unit 27 in order to completely separate the finite second material web 4 from the endless material web 7.

After the cutting operation to completely separate the endless material web 7 and the finite second material web 4 from each other, the second cutting knife 36 of the second cross cut device 35 of the second splicing unit 27 is displaced again back to its starting position, following which the second nip roller 37 of the second splicing unit 27 is displaced again back to its starting position. By so doing, the endless material web 7 now joined to the finite first material web 1 is released. The finite first material web 1 is conveyed over the first glueing roller 30 of the first supply unit 19 and over the second nip roller 37.

Figure 3:
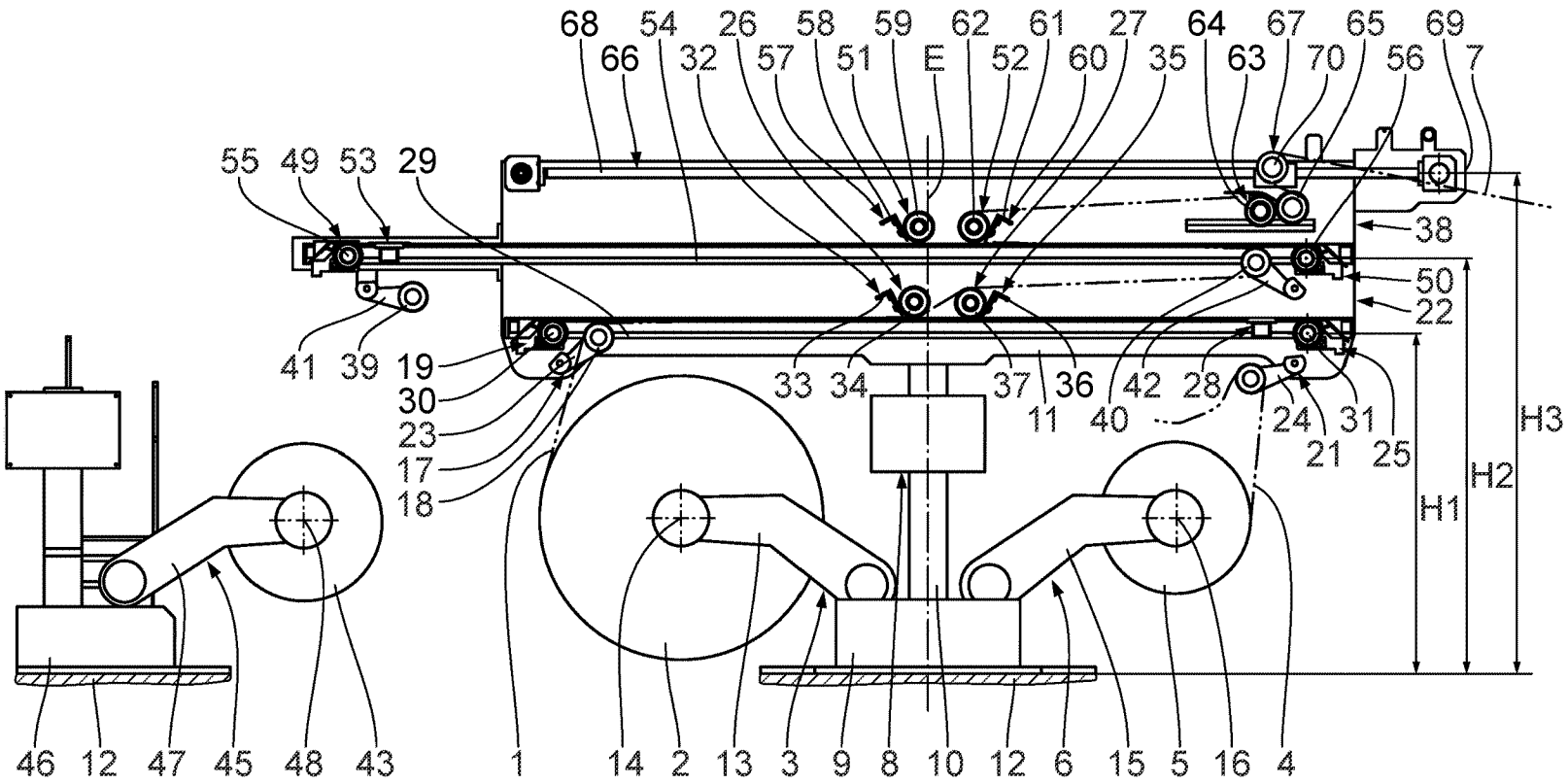

Next, the first supply unit 19 is displaced back along the first guide 29 to a position adjacent to the first feeding roll 18. In its first end position, the storage carriage 67 is located adjacent to the outlet 69. The storage device 66 is empty (FIG. 3).

Since the roll length, roll weight and/or the roll diameter of the finite first material web 1 are known, the splicing device recognises when the first material web roll 2 is nearing its end. Before this occurs, the supplied finite second material web 4 is joined, for example, to the finite first material web 1. This takes place in the same manner as the exchange of the finite material webs 1, 4 as explained earlier. Please refer to that.

Figure 4:
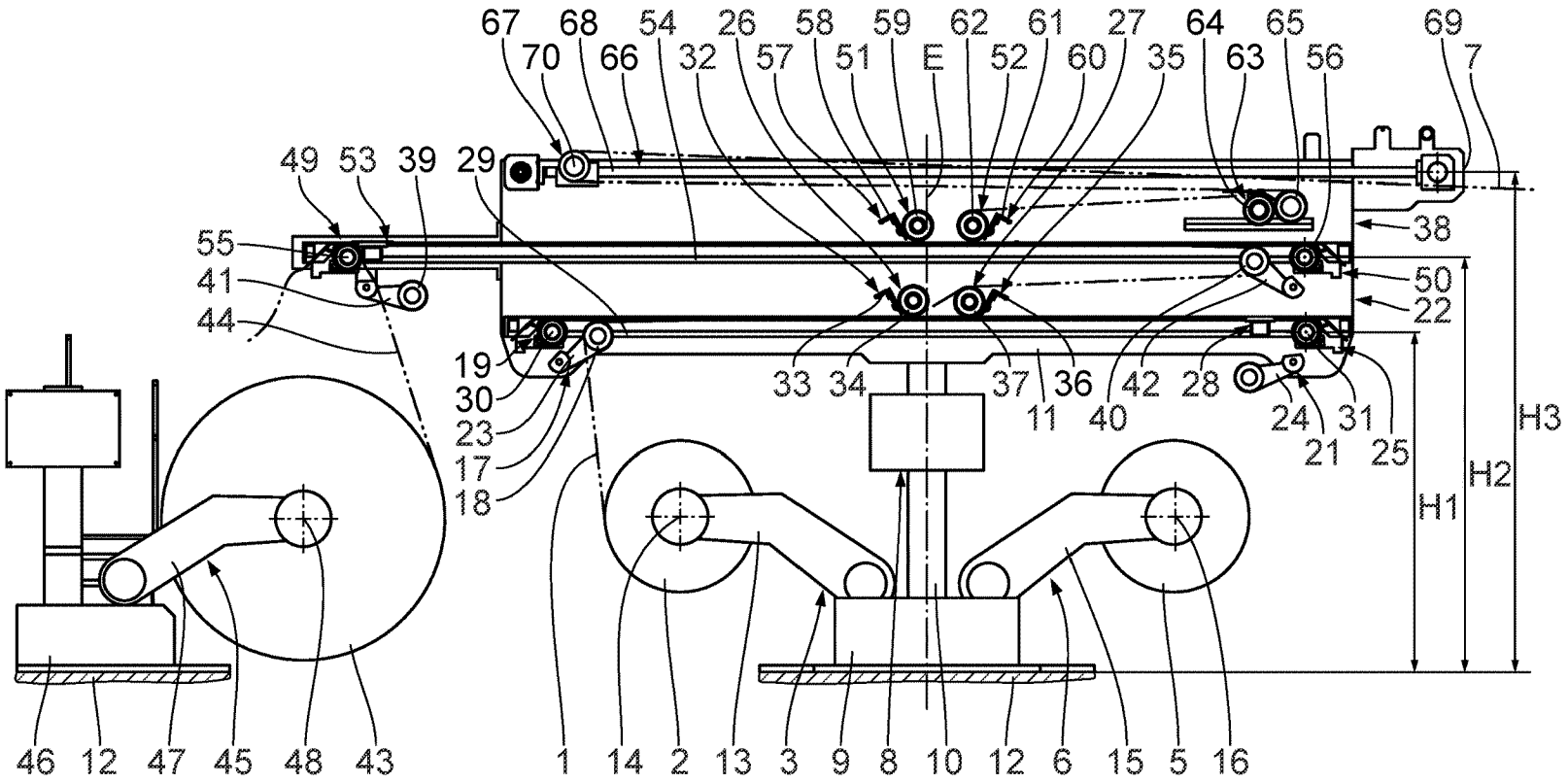
Figure 5:
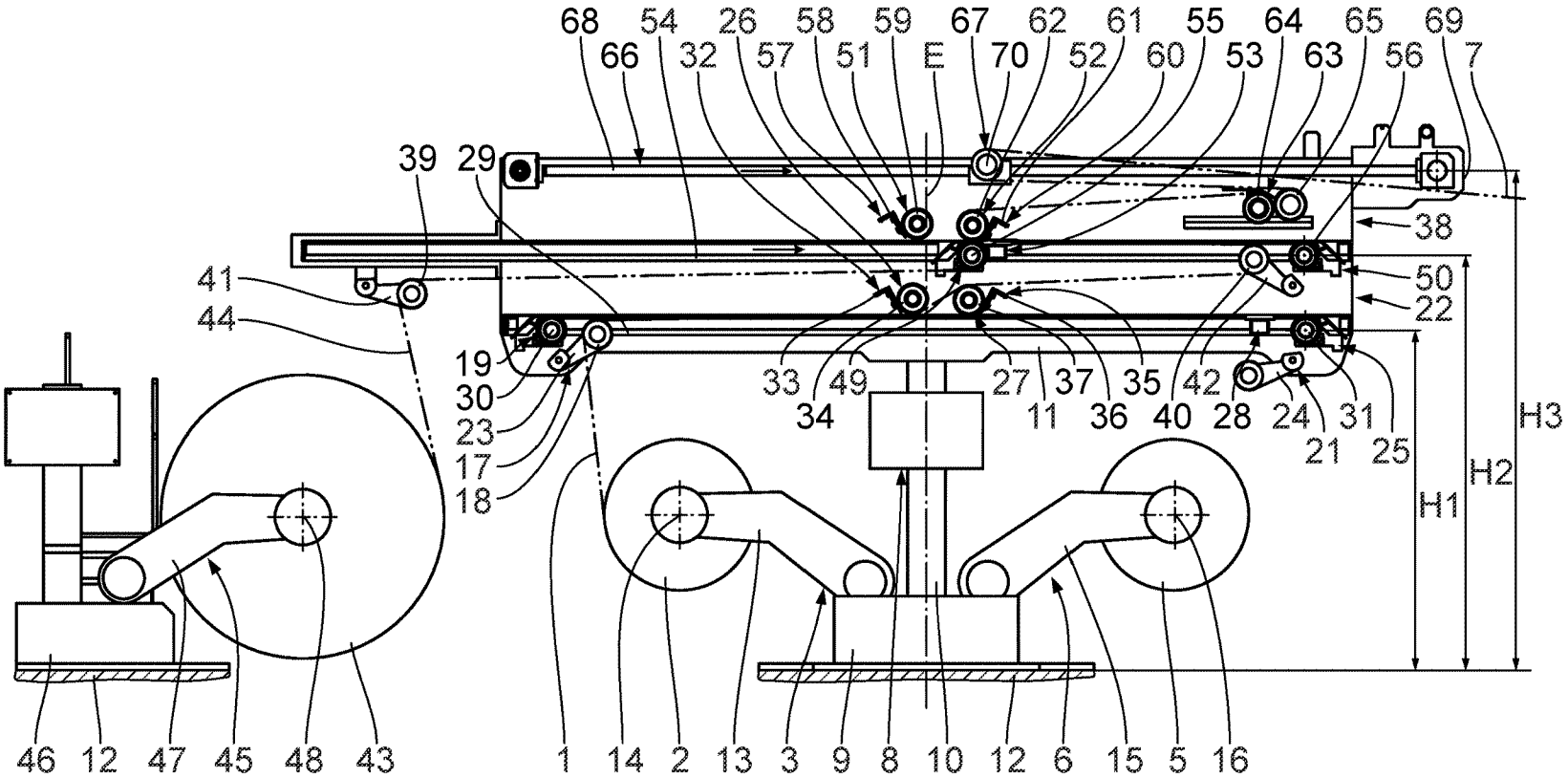
Figure 6:
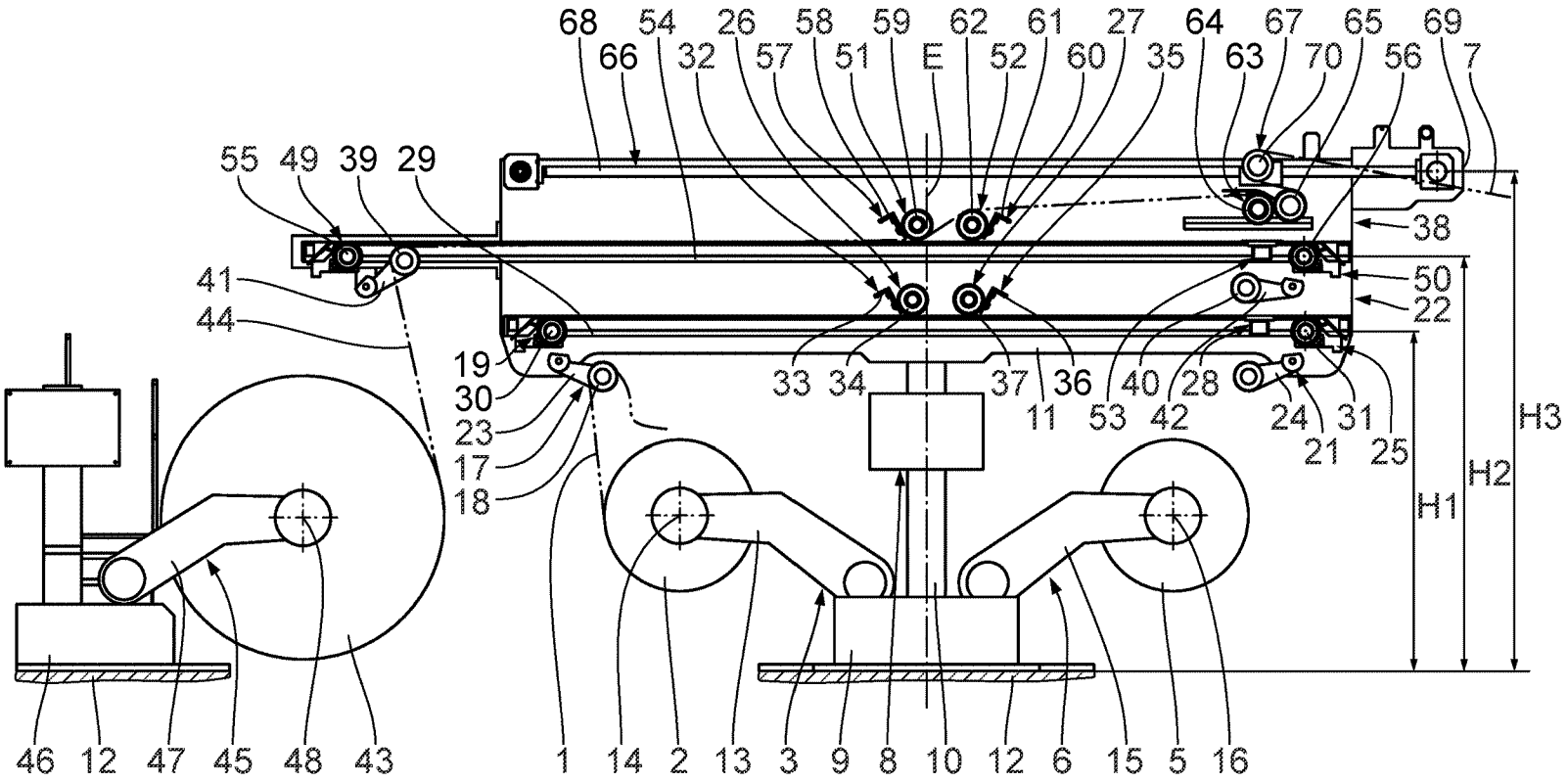

FIGS. 4 to 6 are referred to below in describing the splicing of the third material web 44 to the endless material web 7. The following explains how an exchange takes place from the first material web roll 2 to the third material web 44 when, for example, the first material web roll 2 is nearing its end or is changed over for other reasons to the third material web 44.

The finite first material web 1 is first unwound from the first material web roll 2 and is fed to the first splicing device 22 by the first feeding roll 18, wherein the finite first material web 1 is redirected by approximately 90°.

The finite first material web 1 is fed into the first splicing device 22 over a gap delimited between the first nip roller 34 and the second nip roller 37 out of the first splicing device 22 to the fourth feeding roll 40, which redirects the finite first material web 1 by approximately 180° and feeds it to the second splicing device 38.

In the second splicing device 38, the finite first material web 1 is fed around the fourth nip roller 62, where again it is redirected by approximately 180°.

Next, the finite first material web 1 is redirected from the first redirecting roller 64 and fed around the second redirecting roller 65. At the second redirecting roller 65, the finite first material web 1 is redirected by approximately 180°.

The finite first material web 1 then runs around the material web redirecting roll 70 of the storage carriage 67, which is located in its second end position opposite the outlet 69. Thus the storage device 66 is filled with the endless material web 7. At the material web redirecting roll 70, the finite first material web 1 is redirected by approximately 180°.

The endless material web 7 is then fed to the outlet 69 where it leaves the splicing device.

Since the finite first material web 1 is unwinding continuously, the first material web roll 2 approaches its end after a certain time so that, for example, the third material web 44 can be joined to the finite first material web 1. An exchange between the material web rolls 2, 43 can be due, for example, to a change in the order also.

To accomplish this, the third material web 44 is first threaded by the third feeding device through the third supply unit 49. The third supply unit 49 is arranged adjacent to the third unwinding device 45 also. The second table unit 53 is arranged adjacent to the third supply unit 49, so that the third material web 44 is fixed to the third supply unit 49 or to its third glueing roller 55. Then, the third material web 44 is cut off by the third supply unit 49 or its third cross cut unit. Then the third material web 44 is provided with a single-sided adhesive strip at its beginning where it has been cut, which is done preferably by the third supply unit 49. This condition is illustrated in FIG. 4.

Next, the third supply unit 49 and the second table unit 53 are displaced along the second guide 54 to the fourth joining unit 52 (FIG. 5), wherein the third joining unit 51 is passed.

In doing so, the storage carriage 67 is displaced towards its first end position. By displacing the storage carriage 67 towards the outlet 69, the loops formed by the endless material web 7 are dissipated in order that the endless material web 7 continues on to leave the splicing device without interruption or is conveyed without interruption.

Then, the endless material web 7, by means of the fourth nip roller 62 of the fourth joining unit 52, wherein this fourth nip roller 62 is directed by a pneumatically-operated swivel unit (not shown) to the glueing roller 55 of the third supply unit 49, is pressed against the glued end of the single-sided adhesive strip, which is applied to the start of the finite third material web 44 and is located at a predetermined position relative to the first glueing roller 55 of the third supply unit 49. Alternatively, overlap glueing of the material web 7, 44 can take place in the same way with a double-sided adhesive strip. Thus, the endless material web 7 is joined to the third material web 44.

Then the unwinding action of the first unwinding device 3, i.e. the finite first material web 1, is stopped.

In order to produce a cut edge, the second table unit 53 is displaced along the second guide 54 such that a cut by the fourth blade 61, displaced by a linear unit (not shown), of the fourth cross cut device 60 of the fourth joining unit 52 can plunge into a recess provided across the entire width in the second table unit 53 for the fourth cutting knife 61 of the fourth cross cut device 60 of the fourth joining unit 52 in order to completely separate the finite first material web 1 from the endless material web 7.

After the cutting operation to completely separate the endless material web 7 and the finite first material web 1 from each other, the fourth cutting knife 61 of the fourth cross cut device 60 of the fourth joining unit 52 is displaced again back to its starting position, following which the fourth nip roller 62 of the fourth joining unit 52 is displaced again back to its starting position. By so doing, the endless material web 7 now joined to the third material web 44 is released. The third material web 44 is conveyed by the third glueing roller 55 of the third supply unit 49 to the fourth nip roller 62.

Next, the third supply unit 49 is displaced back along the second guide 54 to a position adjacent to the third unwinding device 45 (FIG. 6).

The third material web 44 is fed to the second splicing device 38 over a gap delimited between the third nip roller 59 and the fourth nip roller 61 out of the second splicing device 38. The third material web 44 is then redirected from the first redirecting roller 64 and fed around the second redirecting roller 65. At the second redirecting roller 65, the third material web 44 is redirected by approximately 180°.

The third material web 44 then runs around the material web redirecting roll 70 of the storage carriage 67 which is located in its first end position adjacent to the outlet 69. Thus the storage device 66 is empty. At the material web redirecting roll 70, the third material web 44 is redirected by approximately 180°.

Figure 7:
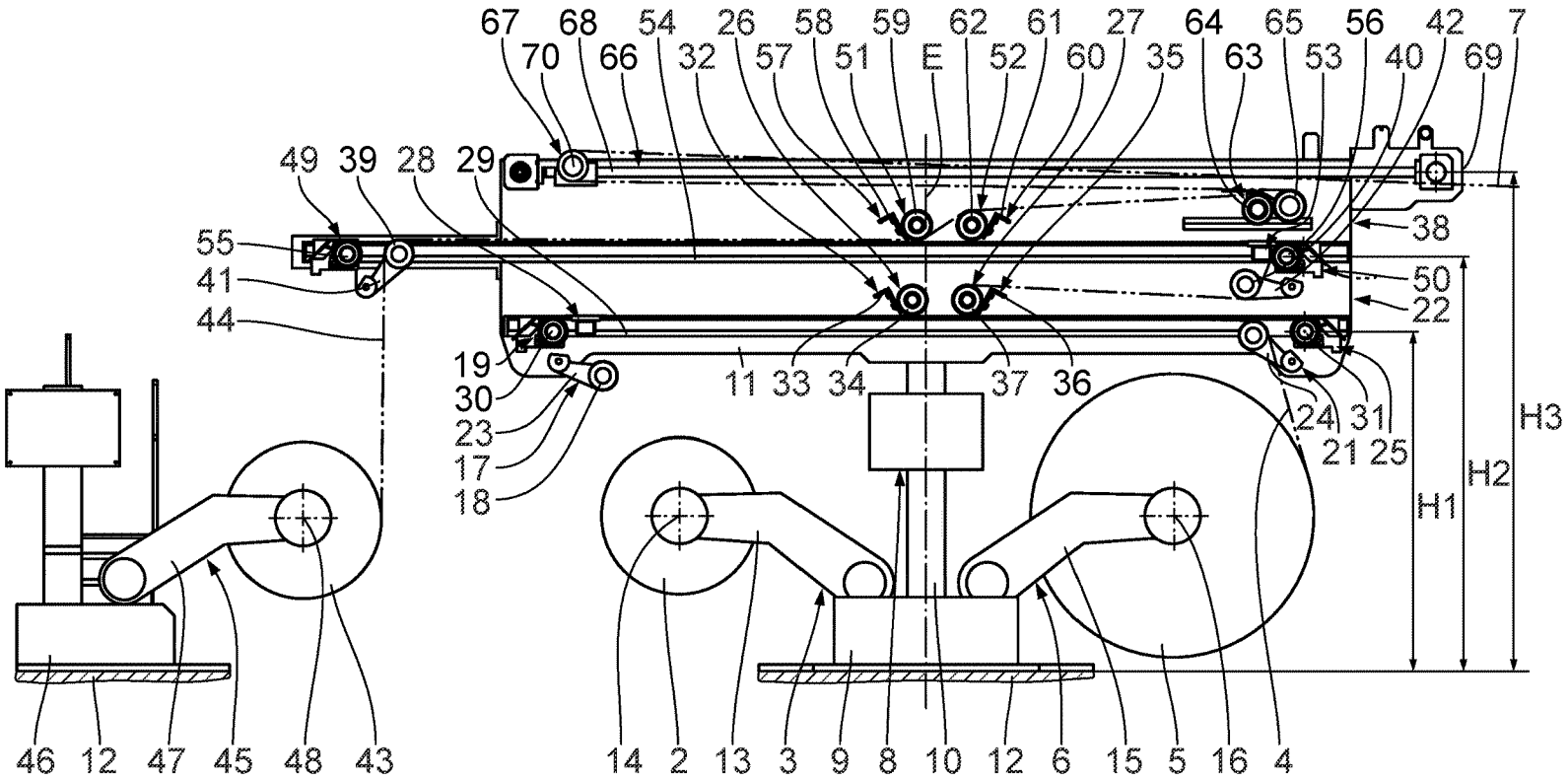
Figure 8:
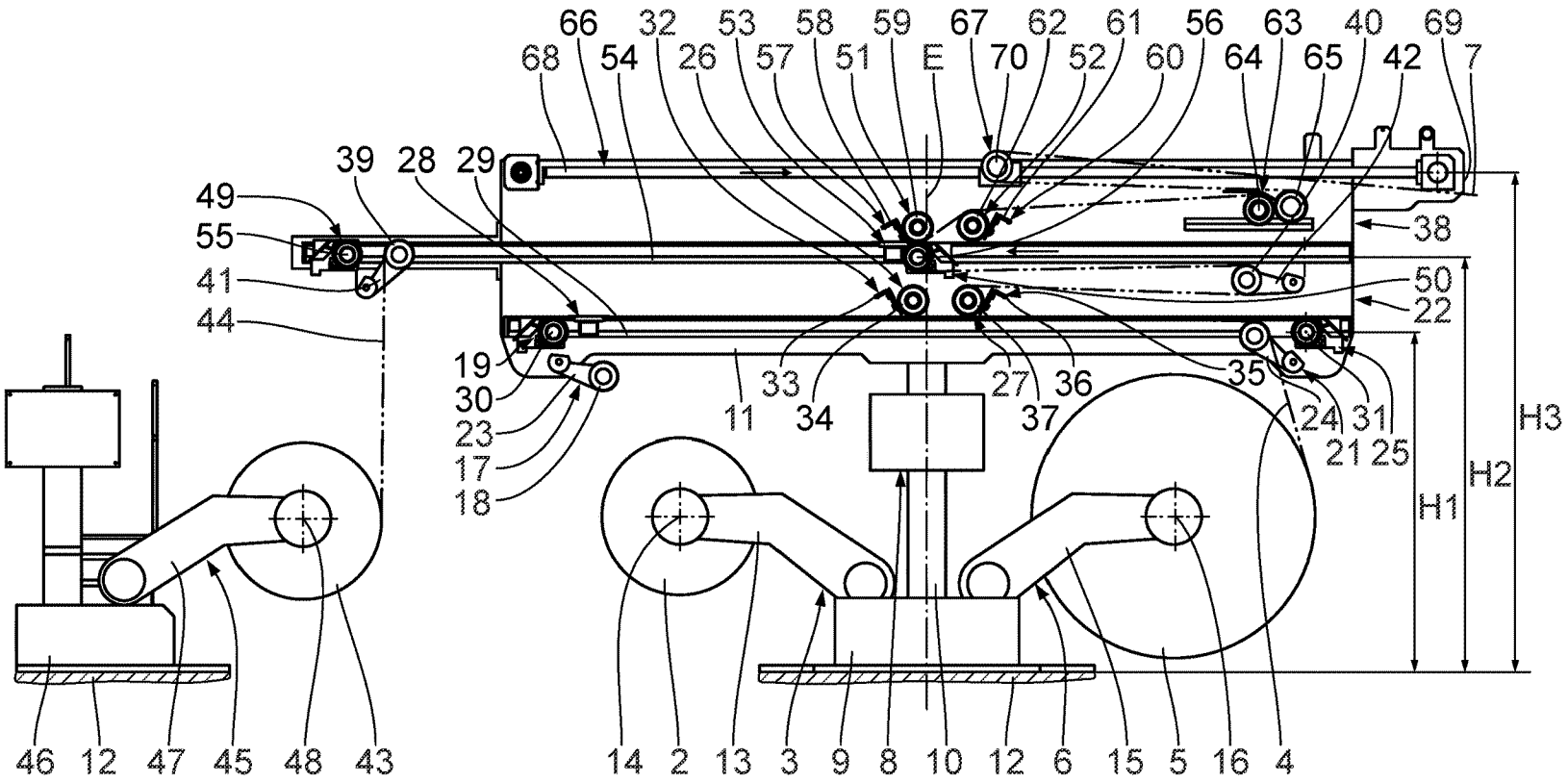
Figure 9:
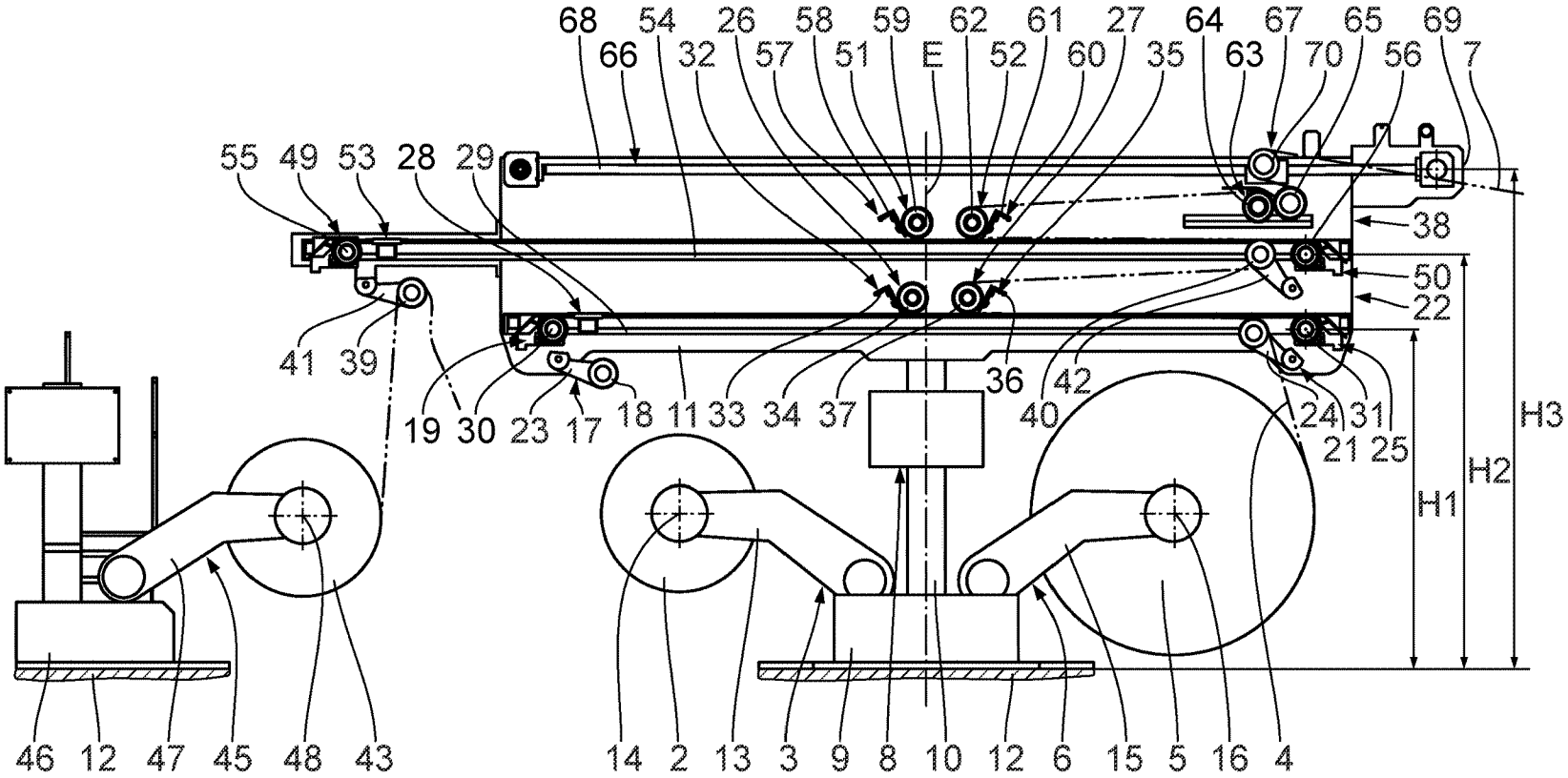

FIGS. 7 to 9 are referred to below in describing the splicing of the second material web 4 to the endless material web 7. The following explains how an exchange takes place from the third material web 44 to the second material web roll 5 when, for example, the third material web 44 is nearing its end or is changed over for other reasons to the second material web 4.

The third material web 44 is unwound from the third dispensing device 44 and is fed to the second splicing device 38 bu the third feeding roll 39, where the third material web 44 is redirected by approximately 90°.

The third material web 44 is fed to the second splicing device 38 over a gap delimited between the third nip roller 59 and the fourth nip roller 62 out of the second splicing device 38. The third material web 44 is redirected from the first redirecting roller 64 and fed around the second redirecting roller 65. At the second redirecting roller 65, the third material web 44 is redirected by approximately 180°.

The third material web 44 then runs around the material web redirecting roll 70 of the storage carriage 67 which is located in its second end position opposite the outlet 69. Thus the storage device 66 is filled with the endless material web 7. At the material web redirecting roll 70, the third material web 44 is redirected by approximately 180°.

The endless material web 7 is then fed to the outlet 69 where it leaves the splicing device.

Since the third material web 44 is unwinding continuously, it approaches its end after a certain time so that, for example, the finite second material web 4 can be joined to the third material web 44. An exchange between the material web rolls 43, 5 can be due, for example, to a change in the order also.

To accomplish this, the finite second material web 4 is first fed by the second feeding device 21 to the second nip roller 37, which redirects the finite second material web 4 by approximately 180°. The finite second material web 4 is threaded by the fourth redirecting roll 40 through the fourth supply unit 50. Also, the fourth supply unit 50 is arranged adjacent to the fourth redirecting device. The second table unit 53 is arranged adjacent to the fourth supply unit 50 so that the finite second material web 4 is fixed to the fourth supply unit 50 or to its fourth glueing roller 56. Then, the finite second material web 4 is cut off by the fourth supply unit 50 or its fourth cross cut unit. Then the finite second material web 4 is provided with a single-sided or double-sided adhesive strip at its beginning where it has been cut, which is done preferably by the fourth supply unit 50. This condition is illustrated in FIG. 7.

Next, the fourth supply unit 50 and the second table unit 53 are displaced along the second guide 54 to the third joining unit 51 (FIG. 8), wherein the fourth joining unit 52 is passed.

In doing so, the storage carriage 67 is displaced towards its first end position. By displacing the storage carriage 67 towards the outlet 69, the loops formed by the endless material web 7 are dissipated in order that the endless material web 7 continues on to leave the splicing device without interruption or is conveyed without interruption.

Then, the endless material web 7, by means of the third nip roller 59 of the third joining unit 51, wherein this third nip roller 59 is directed by a pneumatically-operated swivel unit (not shown) to the fourth glueing roller 56 of the fourth supply unit 50, is pressed against the glued end of the single-sided adhesive strip, which is applied to the start of the finite second material web 4 and is located at a predetermined position on the fourth glueing roller 56 of the fourth supply unit 50. Thus, the endless material web 7 is joined to the finite second material web 4.

Then the unwinding action of the third dispensing device 45, i.e. the third material web 44, is stopped.

In order to produce a cut edge, the second table unit 53 is displaced along the second guide 54 such that a cut by the third blade 58, displaced by a linear unit (not shown), of the third cross cut device 57 of the third joining unit 51 can plunge into a recess provided across the entire width in the second table unit 53 for the third cutting knife 58 of the third cross cut device 57 of the third joining unit 51 in order to completely separate the third material web 44 from the endless material web 7.

After the cutting operation to completely separate the endless material web 7 and the third material web 44 from each other, the third cutting knife 58 of the third cross cut device 57 of the third joining unit 51 is displaced again back to its starting position, following which the third nip roller 59 of the third joining unit 51 is displaced again back to its starting position. By so doing, the endless material web 7 now joined to the finite second material web 4 is released.

The finite second material web 4 is fed by the fourth nip roller 62 of the fourth joining unit 52.

Next, the fourth supply unit 52 is displaced back along the second guide 54 to a position adjacent to the second unwinding device 6. The finite second material web 4 then runs around the material web redirecting roll 70 of the storage carriage 67, which is located in its first end position adjacent to the outlet 69. Thus the storage device 66 is empty. At the material web redirecting roll 70, the finite second material web 4 is redirected by approximately 180° (FIG. 9).

What is claimed is:

1. A splicing facility for splicing material webs to output an endless material web, the splicing facility comprising:

a first dispensing device for dispensing a finite first material web from a first material web roll;

a second dispensing device for dispensing a finite second material web from a second material web roll;

a third dispensing device for dispensing a third material web, the third dispensing device being configured as an unwinding device;

a first splicing device for splicing together the finite first material web and the finite second material web, wherein the first dispensing device comprises a first feed device configured to feed the finite first material web from the first material web roll to the first splicing device and the second dispensing device comprises a second feed device configured to feed the finite second material web from the second material web roll to the first splicing device and the first splicing device comprises at least one joining unit for splicing together the finite first material web and the finite second material web to comprise the endless material web;

a second splicing device for splicing together the third material web and the endless material web comprised of one of the group comprising the finite first material web and the finite second material web, wherein the third dispensing device comprises a third feed device configured to feed the third material web from the third material web roll to the second splicing device and the second splicing device comprises at least one joining unit for splicing together the third material web and the endless material comprised of one of the group comprising the finite first material web and the finite second material web;

a fourth feed device configured to feed the endless material web to the second splicing device; and an outlet for the endless material web from the splicing facility, wherein the first splicing device and the second splicing device are arranged at different heights.

2. A splicing facility according to claim 1, wherein the first splicing device and the second splicing device are arranged one over the other.

3. A splicing facility according to claim 1, wherein the second splicing device is arranged above the first splicing device.

4. A splicing facility according to claim 1, wherein the first splicing device and the second splicing device overlap each other at least in certain regions.

5. A splicing facility according to claim 1, wherein the second splicing device projects laterally compared with the first splicing device towards the third unwinding device.

6. A splicing facility according to claim 1, wherein the first splicing device and the second splicing device are supported on a common base frame.

7. A splicing facility according to claim 1, wherein the first splicing device and the second splicing device can be actuated independently from each other.

8. A splicing facility according to claim 1, wherein the first splicing device further comprises at least one displaceable supply unit for feeding the finite-material web requiring splicing to the at least one joining unit, and a displaceable first table unit to interact with at least one of the group comprising the at least one joining unit and the at least one supply unit.

9. A splicing facility according to claim 1, wherein the second splicing device further comprises at least one displaceable further supply unit for feeding the material web requiring splicing to the at least one further joining unit, and a displaceable second table unit to interact with at least one of the group comprising theat least one further joining unit and the at least one further supply unit.

10. A splicing facility according to claim 1, comprising a storage device for creating material web loops in the created endless material web.

11. A splicing facility according to claim 10, comprising a storage device for dispersing material loops in the created endless material web.

12. A splicing facility according to claim 10, wherein the storage device is arranged above the first splicing device and second splicing device.

13. A splicing facility according to claim 1, wherein the first dispensing device, the second dispensing device and the third dispensing device are arranged alongside each other.

14. A method for splicing material webs, comprising the following steps:

dispensing a finite first material web from a first material web roll by means of a first dispensing device, dispensing a finite second material web from a second material web roll by means of a second dispensing device, dispensing a third material web by means of a third dispensing device, the third dispensing device being configured as an unwinding device, splicing the finite first material web and finite second material web to the endless material web by means of a first splicing device, wherein a first feed device of the first dispensing device feeds the finite first material web from the first material web roll to the first splicing device and a second feed device of the second dispensing device feeds the finite second material web from the second material web roll to the first splicing device and the first splicing device comprises at least one joining unit for splicing together the finite first material web and the finite second material web to comprise the endless material web, and splicing the third material web and the endless material web comprised of one of the group comprising the finite first material web and the finite second material web by a second splicing device, wherein a third feed device of the third dispensing device feeds the third material web from the third material web roll to the second splicing device and the second splicing device comprises at least one joining unit for splicing together the third material web and the endless material comprised of one of the group comprising the finite first material web and the finite second material web, feeding the endless material web to the second splicing device with a fourth feeding device, and outputting the endless material web at an output for the endless material web, wherein the first splicing device and the second splicing device are arranged at different heights.

15. A splicing facility for splicing material webs, the splicing facility comprising:

a first dispensing device configured to dispense a finite first material web from a first material web roll;

a second dispensing device configured to dispense a finite second material web from a second material web roll;

a third dispensing device configured to dispense a third material web from a third material web roll, the third dispensing device being configured as an unwinding device unwinding the third material web from the third material web role to dispense the third material web;

a first splicing device configured to splice together the finite first material web and the finite second material web, wherein the first dispensing device comprises a first feed device configured to feed the finite first material web from the first material web roll to the first splicing device and the second dispensing device comprises a second feed device configured to feed the finite second material web from the second material web roll to the first splicing device and the first splicing device comprises at least one joining unit for splicing together the finite first material web and the finite second material web to comprise an endless material web;

a second splicing device, the first splicing device being arranged at a different height from the second splicing device, wherein the third dispensing device comprises a third feed device configured to feed the third material web from the third material web roll to the second splicing device and the second splicing device comprises at least one joining unit configured to splice together the third material web and the endless material web comprised of one of the group comprising the finite first material web and the finite second material web;

a fourth feeding device configured to feed the endless material web to the second splicing device; and an outlet for output of the endless material web from the splicing facility.

16. A splicing facility according to claim 15, wherein the first splicing device and the second are arranged one over the other with the second splicing device arranged above the first splicing device.

17. A splicing facility according to claim 16, further comprising a common base frame, wherein the first splicing device and the second splicing device are supported on the common base frame.

18. A splicing facility according to claim 15, wherein the first splicing device further comprises:

a displaceable supply unit configured to feed the finite-material web to the joining unit; and a displaceable first table unit configured to interact with at least one of the joining unit and the supply unit.

19. A splicing facility according to claim 18, wherein the second splicing device further comprises:

a displaceable further supply unit configured to feed the material web to the at least one further joining unit; and a displaceable second table unit configured to interact with at least one of the further joining unit and the further supply unit.

20. A splicing facility according to claim 15, comprising a storage device configured to create material web loops in the created endless material web.

* * * * *